US006472986B1

(12) United States Patent
Sorriaux

(10) Patent No.: US 6,472,986 B1
(45) Date of Patent: Oct. 29, 2002

(54) DEVICE FOR SIGNALLING SPATIAL SEPARATION OR CLOSENESS BEYOND OR WITHIN A PREDETERMINED LIMIT

(76) Inventor: Pierre Sorriaux, 22, avenue de l'Opéra, 75001 Paris (FR)

( * ) Notice: Subject to any disclaimer, the term of this patent is extended or adjusted under 35 U.S.C. 154(b) by 0 days.

(21) Appl. No.: 09/821,459

(22) PCT Filed: Oct. 7, 1999

(86) PCT No.: PCT/FR99/02399

§ 371 (c)(1),
(2), (4) Date: Apr. 6, 2001

(87) PCT Pub. No.: WO00/21049

PCT Pub. Date: Apr. 13, 2000

(30) Foreign Application Priority Data

Oct. 7, 1998 (FR) ..... 98 12555

(51) Int. Cl.[7] ..... G08B 13/14

(52) U.S. Cl. ..... 340/571; 340/573.4; 340/568.1; 342/42

(58) Field of Search ..... 340/571, 573.1, 340/573.4, 568.1, 568.4, 568.6, 686.6; 342/42

(56) References Cited

U.S. PATENT DOCUMENTS 5,392,049 A * 2/1995 Gunnarsson ..... 342/42
5,477,210 A * 12/1995 Belcher ..... 340/573
5,552,773 A * 9/1996 Kuhnert ..... 340/573
5,757,271 A * 5/1998 Andrews ..... 340/568
5,801,627 A * 9/1998 Hartung ..... 340/568.1
5,841,352 A * 11/1998 Prakash ..... 340/573.4
5,912,623 A * 6/1999 Pierson ..... 340/573.4
6,118,376 A * 9/2000 Regester ..... 340/568.6
6,265,974 B1 * 7/2001 DaAngelo et al. ..... 340/568.1
6,326,889 B1 * 12/2001 Van Horn et al. ..... 340/572.1

* cited by examiner

*Primary Examiner*—John Tweel
(74) *Attorney, Agent, or Firm*—Bacon & Thomas, PLLC

(57) ABSTRACT

A first unit (10) comprises a first transmitter (12) for wireless transmission of a signal in the from of periodic frames comprising identity information encoded in varying form in each frame, and a second unit (20) comprises a first receiver (22) for receiving said signal and for causing an alarm (29) to operate in response to failure to receive or to recognize identity information. Means (**16, 26, 15*a*, 25*a*, 15*b*, 25*b***) are provided for automatically deactivating at least one of the first and second units when they are physically close together, and for automatically activating said units when they are physically separate from each other.

21 Claims, 5 Drawing Sheets

DEVICE FOR SIGNALLING SPATIAL SEPARATION OR CLOSENESS BEYOND OR WITHIN A PREDETERMINED LIMIT

FIELD OF THE INVENTION

A particular application of the invention lies in warning a person when that person becomes separated by more than a certain distance from an article, another person, or an animal for which said person is the holder, guardian, or minder. For example, the article can be an item of personal belongings, of baggage, a key, or a bunch of keys, and the purpose of the apparatus of the invention is to warn its holder that the article has been forgotten or that the holder is too far away to oversee it properly.

Another application of the invention lies in warning a person when that person or some article, other person, or animal approaches a particular place closer than a certain distance, e.g. corresponding to a safety perimeter.

BACKGROUND OF THE INVENTION

French patent application FR 2 676 135 describes a system that is intended more particularly for indicating that a child has gone further than a predetermined distance from its minder. A transmitter unit carried by the child sends a signal to a fixed station near the minder. The fixed station comprises a receiver associated with a circuit for detecting the level of the signal from the transmitter. When received signal level drops below a predetermined threshold because the separation distance has exceeded a certain limit, then an alarm is activated at the receiver. Each of the housings containing a transmitter or a receiver needs to be provided with its own manual on/off control.

Another system intended for child-minding purposes is described in international patent application WO 93/19437. Compared with the preceding system, it presents the advantage of the transmitter and the receiver being activated and deactivated automatically when they are physically separated from each other and when they are united with each other.

International patent application WO 95/02874 relates to a system for monitoring one or more articles by means of a receiver and one or more transmitters that can be associated with respective articles to be monitored. It is stated that not only is an alarm raised when a transmitter goes beyond a certain distance from the receiver, but also that the distance and the direction of the transmitter can be measured; nevertheless no detailed description is given of means for implementing that effect.

European patent application EP 0 838 907 describes in more detail a system for raising an alarm when a mobile telephone becomes separated from a user's belt support or holder by more than some given distance. Transceiver units are associated with the telephone and with the belt support for transmitting signals containing respective identity information and for verifying that the signals are received at satisfactory level and contain the expected identity information. The unit associated with the telephone makes use of the telephone's resources. As soon as the telephone moves away beyond the predetermined distance, or as soon as the unit associated with the telephone no longer recognizes the identity information of the associated belt support, and vice versa, then an alarm is raised by the support and by the telephone, and the telephone switches off automatically.

International patent application WO 93/25983 describes a system comprising two ultrasound transceiver units. In one mode of operation, an alarm is raised at a first unit (a monitoring unit) when the second unit (a monitored unit) no longer receives the signal and alerts the first unit by transmitting a warning signal at high amplitude. In another mode of operation, the monitoring unit sends a signal to the monitored unit which then relays the signal back to the monitoring unit so as to be able to perform a distance measurement and modulate the intensity of the alarm accordingly, such that when the units move closer together again the sound level of the alarm increases. In the second mode of operation, the user can thus locate the monitored unit. That system requires ultrasound transmission. It is not suitable for reliable use in all environments. In addition, in the first embodiment, an alarm is raised only after a powerful warning signal has been transmitted by the monitored unit to the monitoring unit and said warning signal has been received properly by the monitoring unit.

OBJECT AND BRIEF SUMMARY OF THE INVENTION

Compared with the state of the art outlined above, an object of the invention is to propose self-contained apparatus suitable for multiple uses and capable of operating reliably and with a high degree of security in an environment containing electromagnetic interference and in the presence of other similar apparatuses operating nearby.

To this end, the invention provides apparatus for raising an alarm when a separation distance between a monitored, first unit and an alarm, second unit exceeds a threshold, in which apparatus: the first unit includes means for wireless transmission of a signal containing identity information; the second unit includes means for receiving said signal and for causing alarm means to operate when the level of the received signal is below a predetermined threshold or when the identity information is not recognized in the received signal; and means are provided to cause the first unit and the second unit automatically to take up an inactive state and an active state respectively when they are physically connected to each other and when they are physically separate from each other, in which apparatus, according to the invention:

- the first unit is a self-contained unit which includes encoding means for controlling the transmission of a signal in the form of periodic frames containing identity information encoded in a form that varies with each frame; and
- the second unit is a self-contained unit which includes decoding means suitable for recognizing the identity information in each received frame to cause the alarm means to operate over a predetermined time interval in response to failure to correctly receive or to recognize the identity information in a frame or in a predetermined number of consecutive frames.

Advantageously, means are provided to cause the second unit to take up its inactive state at the end of said predetermined time interval if, during said time interval, the identity information has not been recognized in at least one received frame, if any, and to interrupt operation of said alarm means if, during said predetermined time interval, the identity information is recognized in a received frame.

Transmitting identity information encoded in a form that varies with each frame provides a high level of security not only against attempts at fraud, but also against electromagnetic transmissions in the form of interference or coming from similar apparatuses operating nearby.

The fact that the receiver passes to an inactive state only after a predetermined time interval has elapsed after the alarm has been raised gives the user time to get back close to a monitored article which might have been left behind inadvertently, without deactivating the receiver. The receiver thus remains active without the user needing to perform any maneuver of any kind after the alarm has been raised.

In a variant embodiment, the second unit, or alarm unit includes a transmitter for wireless transmission of an interrogation signal, and the first unit, or monitored unit, includes a receiver for causing at least one frame to be transmitted automatically in response to receiving the interrogation signal.

This disposition makes it possible to associate a plurality of monitored units with the same alarm unit, with the alarm unit interrogating the monitored units sequentially by transmitting personalized interrogation signals.

In yet another variant embodiment, the second unit includes a switch for selecting between a mode in which it monitors separation becoming too great and a mode in which it monitors separation becoming too small, and means are provided in the second unit to cause the alarm to operate when, in the mode for monitoring separation becoming too small, the identity information is recognized in a received frame.

BRIEF DESCRIPTION OF THE DRAWINGS

In the detailed description given below, reference is made to the accompanying drawings, in which.

DETAILED DESCRIPTION OF EMBODIMENTS OF THE INVENTION

Figure 1:
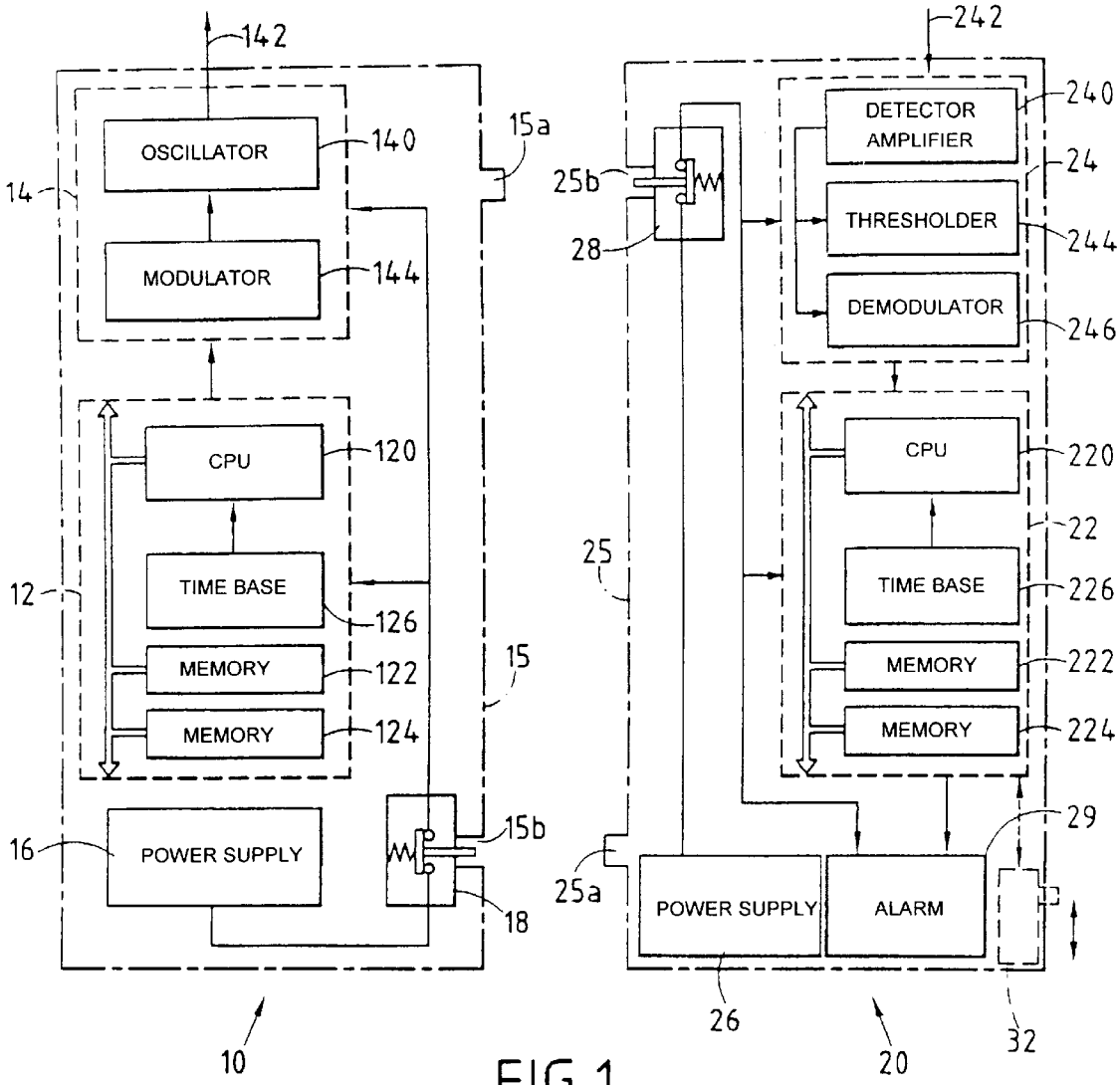
FIG. 1 is a block diagram of a first embodiment of apparatus of the invention.

FIG. 1 shows, very diagrammatically, a first embodiment of alarm apparatus of the invention comprising a first unit 10 constituting a monitored unit, and a second unit 20 constituting an alarm unit.

The first unit 10 comprises a control circuit 12, a transmitter 14, an electrical power supply 16, and an on/off switch 18.

In conventional manner, the control circuit 12 includes a central unit 120, memories 122, 124, and a time base 126 providing clock signals.

The transmitter 14 comprises an oscillator 140 whose output is connected to an antenna 142, and a modulator 144 controlled by the circuit 12. The oscillator produces a signal at a frequency which can be several hundreds of MHz, for example. The digital signals received from the control circuit 12 in the form of periodic frames are transformed into pulse trains that are applied to the antenna 142. Each frame contains identity information specific to the unit 10.

The second unit 20 comprises a control circuit 22, a receiver 24, and electrical power supply 26, an on/off switch 28, and an alarm device 29.

The control circuit 22 includes a central unit 220, memories 222, 224, and a time base 226 supplying clock signals.

The receiver 24 comprises a detector and amplifier circuit 240 whose input is connected to an antenna 242, a threshold circuit 244, and a demodulator 246. The signals transmitted by the unit 10 and received by the antenna 242 are detected by the circuit 240 which produces a signal of amplitude that varies as a function of the distance between the units 10 and 20. When the signal level is below a determined threshold, set by the circuit 244, this circuit inhibits the demodulator 246 SO that no signal is transmitted to the control circuit 22. However, providing the signal level does not drop below said threshold, then the pulse train produced by the circuit 244 is demodulated by the demodulator 246 to enable a digital signal to be produced in the form of a frame suitable for being read by the control circuit 22.

The units 10 and 20 together with their power supplies 16 and 26 in the form of miniature batteries can be made to be very compact and can be housed in cases of small dimensions that are capable of operating in self-contained manner.

The alarm 29 can be of the sound-emitting and/or light-emitting and/or vibrator type. It is triggered by the control circuit 22 when no frame has been received during a given time interval, or when the identity information of the unit 10 is not recognized in a received frame or in a plurality of consecutive received frames. The operation of the units 10 and 20 under the control of programs stored in the control units 12 and 22 is described in detail below.

The units 10 and 20 are activated or put into operation by closing the switches 18 and 28, and this takes place automatically as soon as the units 10 and 20 are separated from each other, and conversely the units 10 and 20 are deactivated or taken out of operation by the switches 18 and 28 being opened which likewise occurs automatically as soon as the units 10 and 20 are put together. The fact that the units 10 and 20 have been activated can be displayed by lighting a light-emitting diode (LED), for example.

In the example shown, the switches 18 and 28 have moving contacts that are actuated mechanically and that are resiliently biased into the closed position. The units 10 and 20 are housed in cases 15 and 25 (represented by chain-dotted lines) provided with respective studs 15*a* and 25*a* which, by penetrating into respective sockets 25*b* and 15*b*, act at the ends of their strokes on the contacts of the switches 18 and 28 when the cases 15 and 25 are put together.

Figure 2:
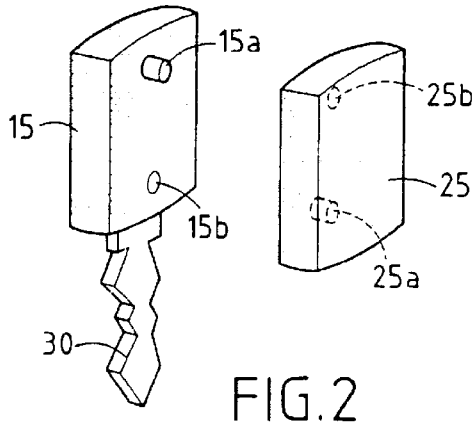
FIG. 2 is a highly diagrammatic representation of an application of the FIG. 1 apparatus.

FIG. 2 shows an example of a case 15 of the first unit associated with a key 30, and the case 25 of the second unit which can be mechanically connected in separable manner to the case 15.

The case 15 can constitute or form part of a key-ring retained by the user. When the key 30 is not in use it is connected via the case 15 to the case 25. To use the key 30, the user detaches it from the case 25, thereby activating the units 10 and 20. If the user subsequently becomes separated from the key 30 by more than a predetermined distance, a warning signal is produced by the case 25. The apparatus then acts as a "don't-forget-me" alarm in the event of the user inadvertently leaving the key behind in a door or in a vehicle contact switch.

The apparatus of the invention is clearly not limited to this application, and a case such as 15 can be associated with any type of object or with a person or with an animal that needs to be kept under surveillance.

Advantageously, the connection between the cases 15 and 25 takes place by plugging the studs 15*a* and 25*a* into the sockets 25*b* and 15*b*, so that the mechanical link means of the cases thus also act on the on/off switches.

Naturally, mechanical or other link means (e.g. magnetic means) distinct from the studs 15*a* and 25*a* and the sockets 25*b* and 15*b* could be provided for releasably uniting the cases 15 and 25.

In a variant embodiment, the on/off switches 18 and 28 could have moving contacts that are magnetically actuatable, e.g. in the form of microswitches housed in vacuum bulbs. The contacts can then be opened by permanent magnets carried by the cases 15 and 25. These magnets could also, optionally, constitute the releasable link means for interconnecting the cases 15 and 25. Separating the units 10 and 20 causes the switches 18 and 28 to close automatically, thereby activating the units 10 and 20.

It should also be observed that the units 10 and 20 can be activated and deactivated automatically by removing the cases 15 and 25 from a common support, and by engaging them thereon, e.g. for storing the cases 15 and 25 on the common support. Link means, e.g. mechanical or magnetic means can be provided to connect the cases in releasable manner with the common support, which link means can also serve to deactivate and activate the on/off switches of the units 10 and 20 automatically as described above.

Figure 3A:
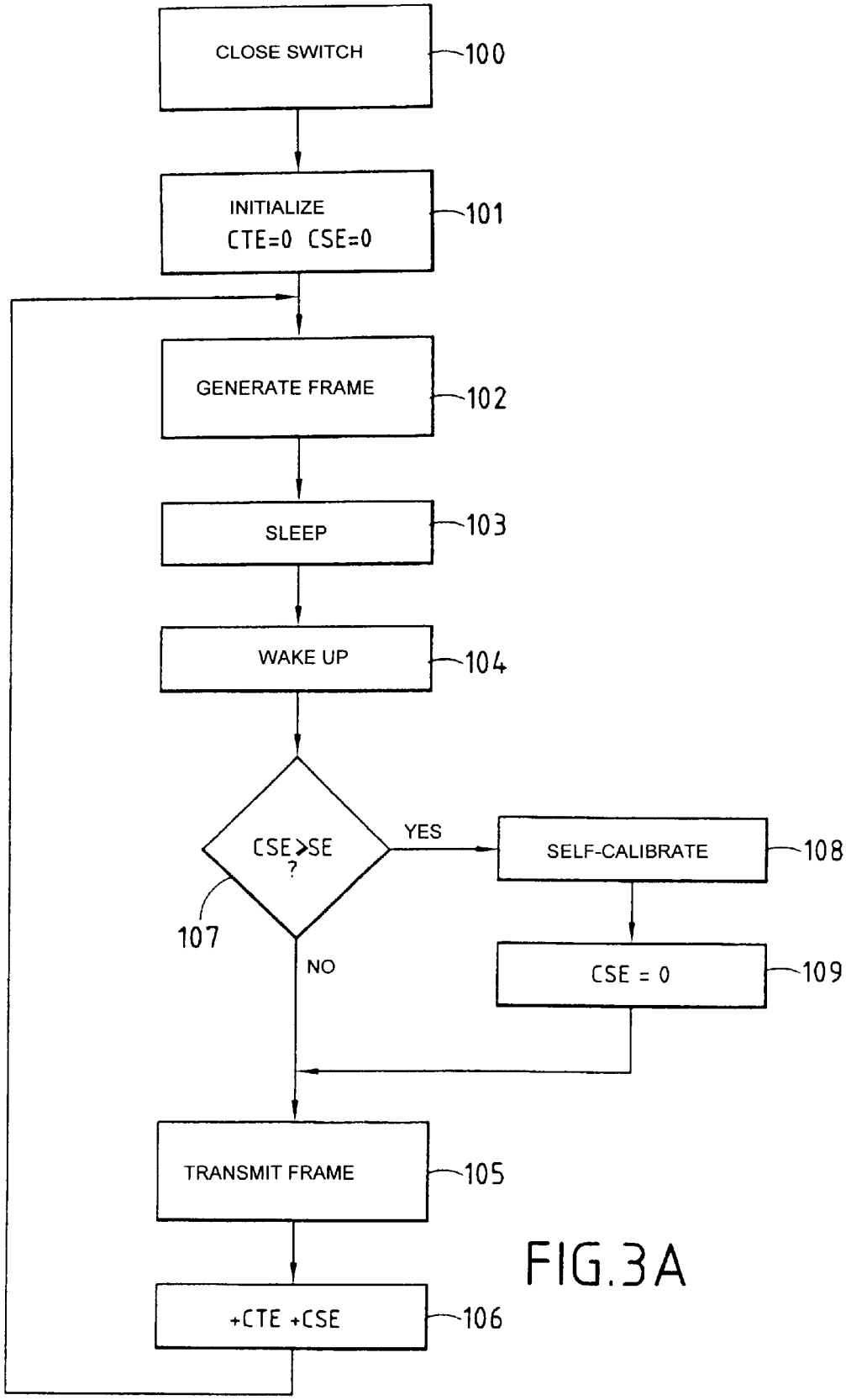
FIGS. 3A and 3B are flow charts showing the operation of the monitored unit and of the alarm unit of the FIG. 1 apparatus.
Figure 3B:
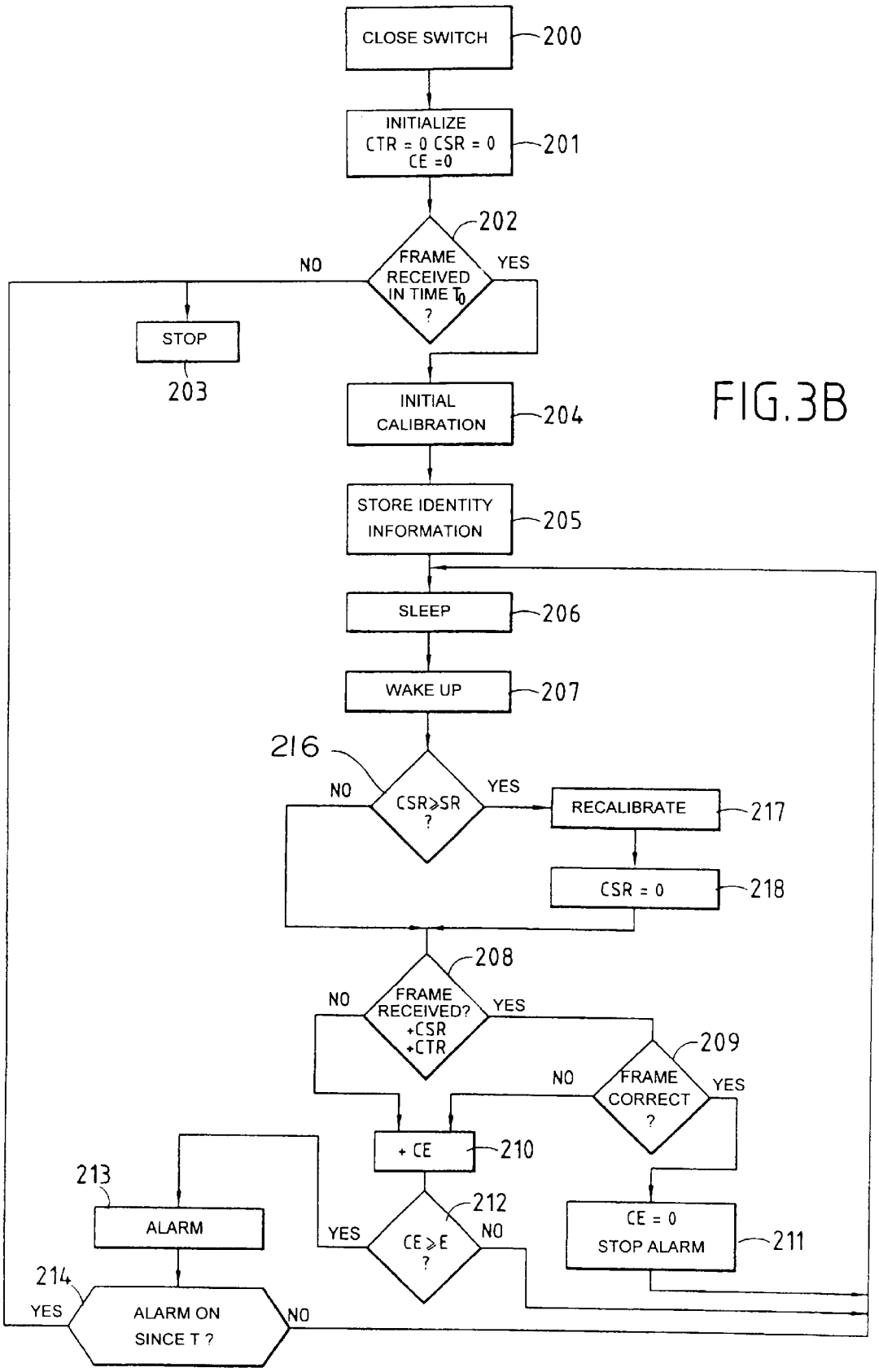

FIGS. 3A and 3B are flow charts respectively showing how the units 10 and 20 operate.

When the switch 18 is closed (step 100), a step 101 is performed of initializing the unit 10, during which step a frame counter CTE and a synchronization counter CSE are both zeroed.

A frame is generated (step 102) including synchronization information and identity information. The synchronization information is in the form of a bit sequence and is intended to provide initial calibration of a watchdog circuit of the unit 20. The identity information is encoded on a plurality of bits, and in the first frame to be generated after initialization it is constituted by a serial number specific to the unit 10 and stored in a memory of the control unit 12 during manufacture of the unit 10.

After a sleep step 103 of duration slightly shorter than the periodicity with which frames are transmitted, e.g. about 2 seconds (s), and after the unit 10 has been woken up (step 104), the frame generated in step 102 is transmitted (step 105). The contents of the counters CTE and CSE are then incremented (step 106) before returning to step 102.

Incrementing the counter CTE causes a new frame to be generated in step 102. Each new frame after the initial frame comprises identity information only and this information is different on each occasion. The identity information inserted in each new frame is obtained by encoding using a preprogrammed coding relationship, starting with the initial serial number and as a function of the content of the frame counter CTE. The information can be of a length that is different from the length of the initial serial number.

Prior to sending a frame, the content of the synchronization counter CSE is examined (test 107). If it reaches a given threshold SE, e.g. corresponding to a predetermined operation duration of 2 minutes (min) or more, auto-calibration is performed (step 108) followed by the counter CSE being zeroed (step 109) prior to moving onto step 105. This auto-calibration consists in measuring and if necessary recalibrating the period of a watchdog circuit, e.g. lying in the range 10 milliseconds (ms) to 40 ms, at the end of which it verifies on each occasion whether the 2 s frame transmission period has elapsed or not. Recalibration of the watchdog circuit is performed on the basis of the internal time base of the control circuit 12 and makes it possible to guarantee that the 2 s period is constant, such that the unit 10 and the unit 20 operates synchronously. The transmitter circuits operate only while the unit 10 is awake, thereby limiting energy consumption.

At the receiver (FIG. 3B), when the switch 28 is closed (step 200), an initialization step 201 is performed during which a frame counter CTR, a synchronization counter CSR, and an error counter CE are zeroed.

If the demodulator 246 does not deliver any frame to the control circuit within a predetermined period $T_0$ after initialization, e.g. 30 s (test 202), then operation of the unit 20 is stopped (step 203). An error signal can then be produced by means of a special indicator light or by causing the alarm 29 to operate in a mode that is different from its alarm mode. Operation of the unit 20 can then restart only after reinitialization. This can be achieved by opening and closing the switches 18 and 28 (by uniting and then separating the units 10 and 20), or by removing and replacing the batteries 16 and 26, or by actuating a special reinitialization button on the units 10 and 20.

If a first frame is received within the period, initial calibration is performed using the synchronization information received with said first frame (step 204) and the initially received identity information as constituted by the serial number of the unit 10 is stored (step 205) so that it can be used for decoding the identity information contained in subsequent frames. Initial calibration enables the beginning of the sleep period of the unit 20 to be synchronized with that of the unit 10 and enables the duration thereof to be defined.

After receiving the first frame, the unit 20 is periodically put to sleep in a step 206 for a predetermined duration that is slightly shorter than the frame transmission period, after which it is woken up in a step 207. With the frame period being selected to be equal to 2 s, for example, the sleep duration for the unit 20 can be selected to be 1840 ms, for example. If after the end of the sleep period no frame is received for the remaining duration of the frame transmission period (test 208), which corresponds to a "time-out" error, then the content of the error counter CE is incremented (step 210). Otherwise, if a frame is received in time, it is verified (test 209). Verification consists in recognizing the identity information contained in the received frame. For this purpose, using a preprogrammed relationship corresponding to the coding relationship used by the unit 10, identity information is computed by the control circuit 22 of the unit 20 using the serial number as initially received and stored, and also using the content of the frame counter CTR. The computed identity information is compared with that contained in the received frames. It will be observed that the frame counter CTR and the synchronization counter CSR are incremented during a test 208 after each step 206. If the received identity information is wrong, the content of the error counter CE is incremented (step 210). If the identify information as verified in step 209 is correct, then the content of the error counter CE is zeroed (step 211) before returning to the sleep step 206.

When the content of the error counter reaches a predetermined value E, e.g. not less than 2 (test 212), the alarm is caused to operate (step 213) and a test is performed to determine whether the alarm 29 has been in operation for a predetermined length of time T, e.g. at least 30 s (test 214). If this is the case, then the operation of the unit 20 is stopped by passing through step 203 and the alarm is switched off. If the alarm has been operating for a length of time that is shorter than the predetermined length of time T, and likewise so long as the content of the error counter CE has not reached the predetermined value E, operation returns to step 206. If the alarm 29 has been in operation for a length of time shorter than T, it is stopped in step 211 in response to correct identity information being recognized in a received frame.

After each step 206, the content of the synchronization counter CSR is examined (cf. test 216) in order to ensure that the unit 20 is recalibrated periodically and aligned on the unit 10. Recalibration (step 217) is performed when the content of the counter CSR reaches a value SR, e.g. corresponding to a duration of 2 min (test 216), and the counter CSR is zeroed (step 218). Recalibration performed on the basis of the clock internal to the control circuit 22 makes it possible to ensure that the durations of the sleep and awake periods are constant, so that the unit 20 is indeed awake when it ought to be receiving a frame. The receiver units 24 are active only while the unit is awake.

In the example described, the alarm is raised when a frame is not received by the demodulator 246 (signal too weak during a frame transmission period), or when frames are received but the identity information is not recognized in two consecutive frames. Naturally, by handling the "time-out" and the "wrong frame" error information appropriately, other configurations could be devised for determining when to operate the alarm 29, e.g. when two or more consecutive frames are not received or when the identity information is not recognized in a single frame or in more than two consecutive frames.

An advantage of the embodiment described above is that the alarm unit 20 does not reinitialize if, after the alarm has operated, said alarm unit is brought back into proximity with the unit 10 before the end of the time interval T, since the alarm is then turned off.

Figure 4:
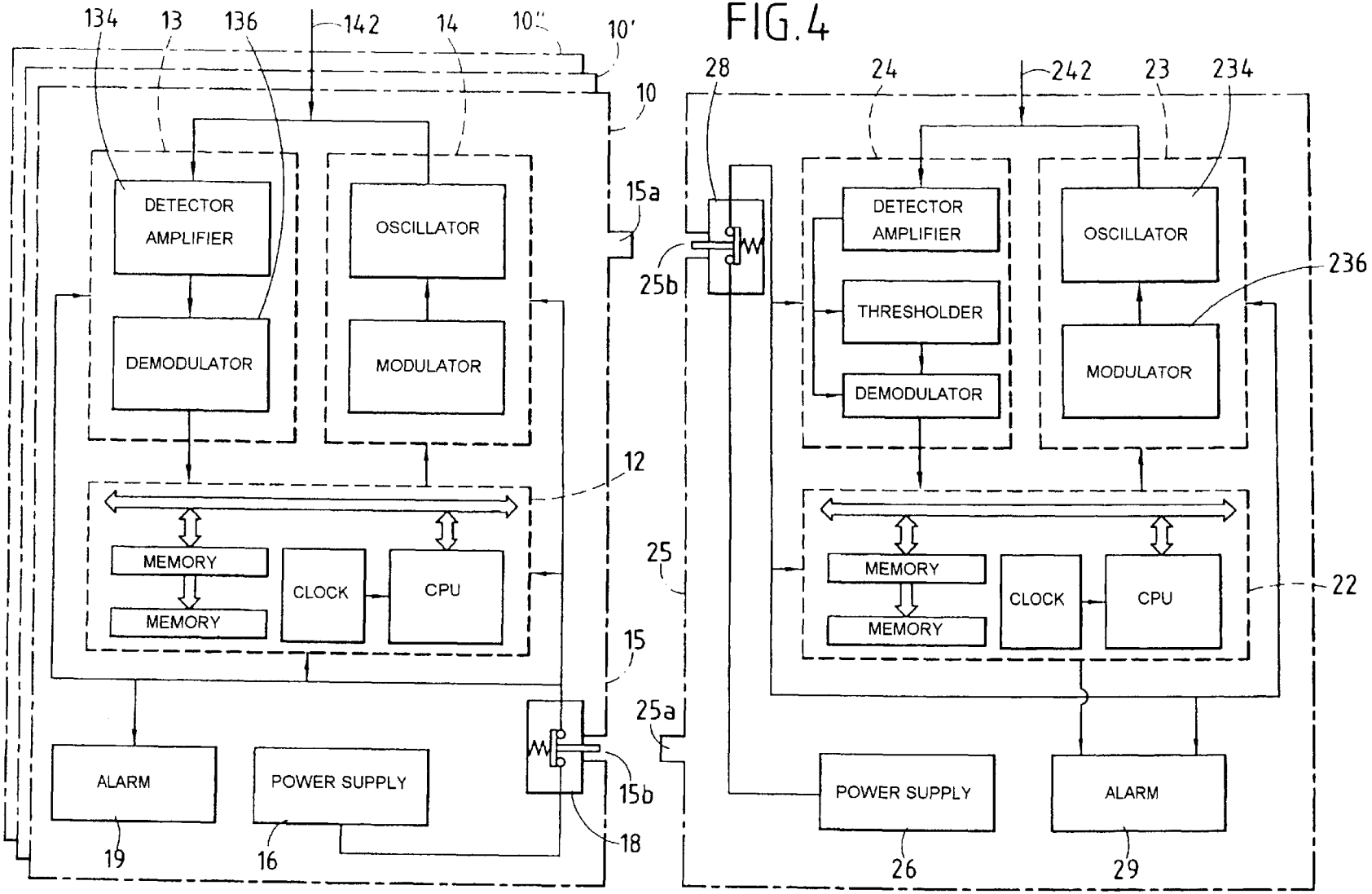
FIG. 4 is a block diagram of a second embodiment of apparatus of the invention.

FIG. 4 shows a second embodiment of apparatus of the invention. Elements which are common to the embodiments of FIGS. 1 and 4 are given the same references and they are not described again in detail.

The second unit 20 differs from that of FIG. 1 in that it has a transmitter 23 connected to the antenna 242. The transmitter 23 comprises an oscillator 234 and a modulator 236 controlled by the control circuit 22. The transmitter produces a periodic interrogation signal in the form of pulse trains.

The first unit 10 differs from that of FIG. 1 in that it comprises a receiver 13 connected to the antenna 142. The receiver 13 comprises a detector and amplifier circuit 134 and a demodulator 136 connected to the control circuit 12. In response to receiving and detecting the interrogation signal, the control circuit 12 causes the transmitter 14 to operate and transmit one or more frames.

The unit 20 can be associated with a plurality of units 10, 10', 10", . . . which are interrogated in turn by varying the interrogation signal in cyclic manner. The interrogation signals for the units 10, 10', 10", . . . differ from one another by their constituent pulse trains being encoded differently. Each unit 10, 10', 10", . . . transmits at least one frame including identity information specific thereto in response to receiving and recognizing an interrogation signal addressed to it. Each transmission of an interrogation signal by the unit 20 defines a window (time interval) during which the unit 20 detects the reception of frames coming from the interrogated unit.

In a variant of the FIG. 4 embodiment, the or each unit 10, 10', 10", . . . is provided with an alarm device 19 which is switched on by the control circuit 12 when no interrogation signal is received or when an interrogation signal is received at insufficient level or is not recognized within a given time interval, e.g. corresponding to one or more periods of the interrogation signal. The receiver 13 can then be provided with a threshold circuit which inhibits operation of the demodulator when the received signal level is insufficient, in the same manner as for the receiver 24 of the unit 20.

By means of this disposition, an alarm can be raised at the or one of the units 10, 10', 10", . . . on going away from the unit 20 by more than a given distance. This alarm, in addition to that produced at the unit 20, makes it easier for the holder of the unit 20 to locate the unit 10, 10', 10", . . . , and thus the article, animal, or person with which it is associated, in the event of abnormal separation. This also makes it possible to exert a dissuasive effect on a person who might have taken an article with which the unit 10, 10', 10", . . . is associated.

Figure 5:
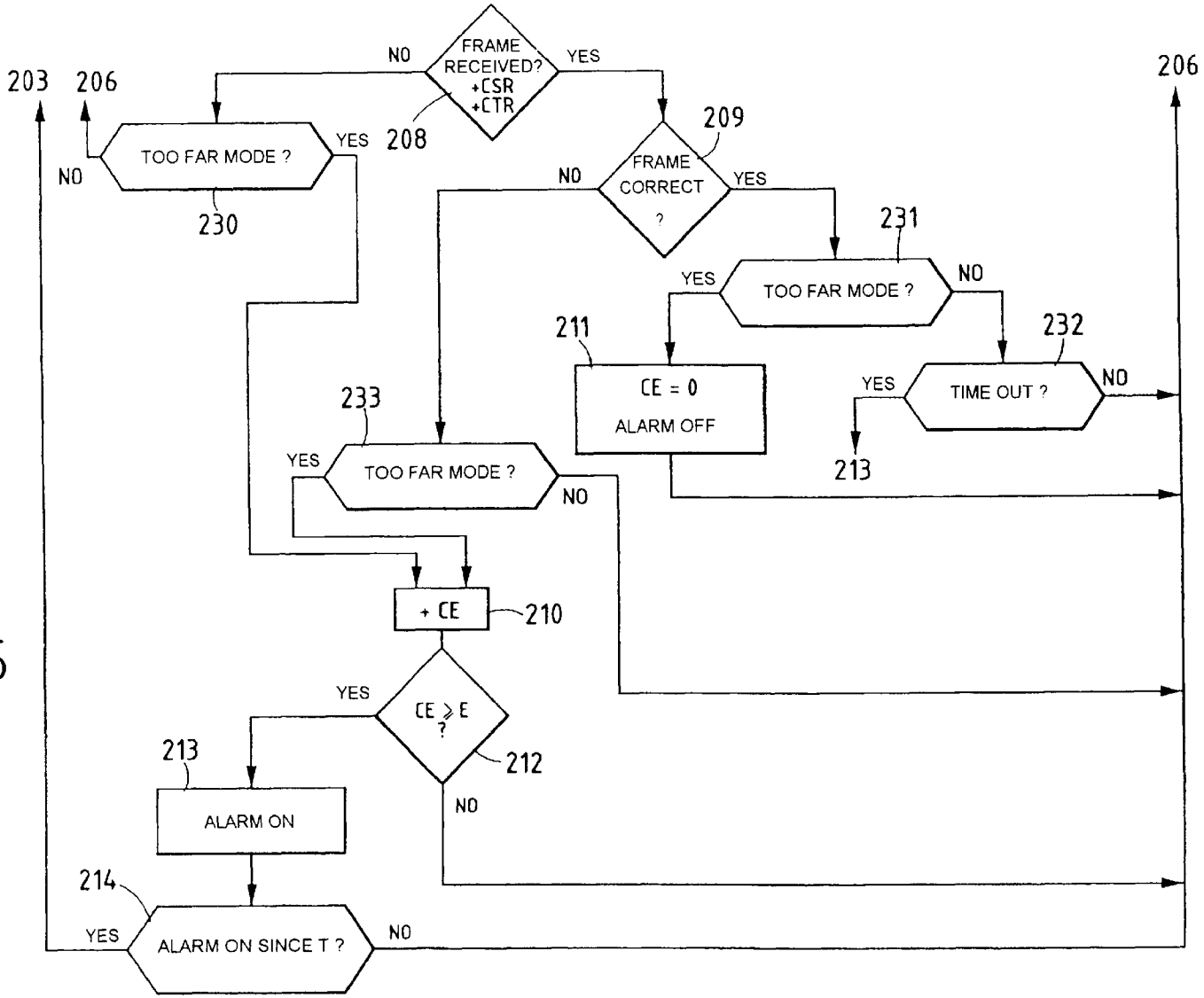
FIG. 5 is a flow chart showing the operation of the alarm unit in a third embodiment of apparatus of the invention.

FIG. 5 shows the operation of a unit 20 in another embodiment of the invention in which the unit 20 is provided with a switch enabling it to switch from a mode in which it monitors separation becoming too great to a mode in which it monitors separation becoming too small. The switch 32 is shown in dashed lines in FIG. 1. The state of the switch 32 is recognized by the control circuit 24.

The operation of the unit 20 then differs from that shown in FIG. 3B as from test 208 (frame received?). If no frame is received, the operating mode as defined by the switch 32 is tested (test 230). When in a mode for monitoring too great a separation, operation moves to step 210 in which the error counter CE is incremented as in FIG. 3B. When in a mode for monitoring too small a separation, operation returns to step 206.

If a frame is received, it is examined to see whether it is correct (test 209). If it is, the monitoring mode is tested (test 231). When monitoring for separation that is too great, operation moves onto step 211 (CE=0 and the alarm is optionally stopped). When monitoring for separation that is too small, a test is made whether a predetermined duration has elapsed since the unit 20 passed into the active state (test 232). If this period has not elapsed, then operation returns to step 206. If the period has elapsed, then operation moves onto step 213 (switch on alarm).

If a received frame is not correct, the monitoring mode is determined (test 233). When monitoring for separation that is too great, operation moves onto step 210 (increment CE). When monitoring for separation that is too small, operation returns to step 206.

By providing a time period during which operation of the alarm is inhibited in the mode for monitoring separation that is too small, it is possible to avoid raising an untimely alarm when the apparatus is put into service and while the initial frames are being received, until the units 10 and 20 have been separated from each other sufficiently. Mutual separation is considered as being sufficient when, in the mode for monitoring separation that is too great, the alarm would be raised. Provision can also be made for the switch 32 to be switched from monitoring separation that is too great to separation that is too small only after the units 10 and 20 have been separated sufficiently.

The mode in which separation is monitored for being too small can be used to detect penetration within a security perimeter around the unit 20. An output connection to an alarm device of greater power can be provided on the case of the unit 20.

What is claimed is:

1. Apparatus for raising an alarm when a separation distance between a monitored first unit and an alarm second unit exceeds a threshold, in which apparatus: the first unit includes means for wireless transmission of a signal containing identity information; the second unit includes means for receiving said signal and for causing alarm means to operate when the level of the received signal is below a predetermined threshold or when the identity information is not recognized in the received signal; and means are provided to cause the first unit and the second unit automatically to take up an inactive state and an active state respectively when they are physically connected to each other and when they are physically separate from each other, the apparatus being characterized in that:

the first unit is a self-contained unit which includes encoding means for controlling the transmission of a signal in the form of periodic frames containing identity information encoded in a form that varies with each frame; and the second unit is a self-contained unit which includes decoding means suitable for recognizing the identity information in each received frame to cause the alarm means to operate over a predetermined time interval in response to failure to receive or to recognize the identity information in a frame or in a predetermined number of consecutive frames.

2. Apparatus according to claim 1, characterized in that means are provided to cause the second unit to take up its inactive state at the end of said predetermined time interval if, during said time interval, the identity information has not been recognized in at least one received frame, if any, and to interrupt operation of said alarm means if, during said predetermined time interval, the identity information is recognized in a received frame.

3. Apparatus according to claim 1 or 2, characterized in that the second unit includes a transmitter for wireless transmission of an interrogation signal, and the first unit includes a receiver for causing at least one frame to be transmitted automatically in response to receiving the interrogation signal.

4. Apparatus according to claim 3, characterized in that the first unit includes an alarm and means responding to failure to correctly receive the interrogation signal by causing said alarm to operate.

5. Apparatus according to claim 1 or 2, characterized in that it comprises a plurality of monitored first units associated with a common alarm second unit, in that the second unit includes a transmitter for wireless transmission of a plurality of distinct interrogation signals in sequential manner each corresponding to a respective monitored first unit, and in that each first unit includes a receiver for automatically causing at least one frame to be transmitted in response to receiving the corresponding interrogation signal.

6. Apparatus according to claim 3, characterized in that the interrogation signals are transmitted periodically.

7. Apparatus according to claim 1 or 2, characterized in that the second unit includes a switch for selecting between a mode in which it monitors separation becoming too great and a mode in which it monitors separation becoming too small, and means are provided in the second unit to cause the alarm to operate when, in the mode for monitoring separation becoming too small, the identity information is recognized in a received frame.

8. Apparatus according to claim 7, characterized in that means are provided in the second unit so that while in its mode for monitoring separation becoming too small, operation of the alarm is inhibited for a predetermined length of time after taking up the active state.

9. Apparatus according to claim 3, characterized in that it comprises a plurality of monitored first units associated with a common alarm second unit, in that the second unit includes a transmitter for wireless transmission of a plurality of distinct interrogation signals in sequential manner each corresponding to a respective monitored first unit, and in that each first unit includes a receiver for automatically causing at least one frame to be transmitted in response to receiving the corresponding interrogation signal.

10. Apparatus according to claim 4, characterized in that it comprises a plurality of monitored first units associated with a common alarm second unit, in that the second unit includes a transmitter for wireless transmission of a plurality of distinct interrogation signals in sequential manner each corresponding to a respective monitored first unit, and in that each first unit includes a receiver for automatically causing at least one frame to be transmitted in response to receiving the corresponding interrogation signal.

11. Apparatus according to claim 5, characterized in that the interrogation signals are transmitted periodically.

12. Apparatus according to claim 5, characterized in that the second unit includes a switch for selecting between a mode in which it monitors separation becoming too great and a mode in which it monitors separation becoming too small, and means are provided in the second unit to cause the alarm to operate when, in the mode for monitoring separation becoming too small, the identity information is recognized in a received frame.

13. Apparatus according to claim 12, characterized in that means are provided in the second unit so that while in its mode for monitoring separation becoming too small, operation of the alarm is inhibited for a predetermined length of time after taking up the active state.

14. Apparatus for raising an alarm when a separation distance between a monitored first unit and an alarm second unit exceeds a threshold, in which apparatus: the first unit includes means for wireless transmission of a signal containing identity information; and the second unit includes means for receiving said signal and for causing alarm means to operate when the level of the received signal is below a predetermined threshold or when the identity information is not recognized in the received signal; the apparatus being characterized in that:

the first unit is a self-contained unit which includes encoding means for controlling the transmission of a signal in the form of periodic frames containing identity information encoded in a form that varies with each frame; and the second unit is a self-contained unit which includes decoding means suitable for recognizing the identity information in each received frame to cause the alarm means to operate over a predetermined time interval in response to failure to receive or to recognize the identity information in a frame or in a predetermined number of consecutive frames.

15. Apparatus according to claim 14, characterized in that means are provided to cause the second unit to take up an inactive state at the end of said predetermined time interval if, during said time interval, the identity information has not been recognized in at least one received frame, if any, and to interrupt operation of said alarm means if, during said predetermined time interval, the identity information is recognized in a received frame.

16. Apparatus according to claim 14, characterized in that the second unit includes a transmitter for wireless transmission of an interrogation signal, and the first unit includes a receiver for causing at least one frame to be transmitted automatically in response to receiving the interrogation signal.

17. Apparatus according to claim 16, characterized in that the first unit includes an alarm and means responding to failure to correctly receive the interrogation signal by causing said alarm to operate.

18. Apparatus according to claim 14 characterized in that it comprises a plurality of monitored first units associated with a common alarm second unit, in that the second unit includes a transmitter for wireless transmission of a plurality of distinct interrogation signals in sequential manner each corresponding to a respective monitored first unit, and in that each first unit includes a receiver for automatically causing at least one frame to be transmitted in response to receiving the corresponding interrogation signal.

19. Apparatus according to claim 16, characterized in that the interrogation signals are transmitted periodically.

20. Apparatus according to claim 14, characterized in that the second unit includes a switch for selecting between a mode in which it monitors separation becoming too great and a mode in which it monitors separation becoming too small, and means are provided in the second unit to cause the alarm to operate when, in the mode for monitoring separation becoming too small, the identity information is recognized in a receiving frame.

21. Apparatus according to claim 20, characterized in that means are provided in the second unit so that while in its mode for monitoring separation becoming too small, operation of the alarm is inhibited for a predetermined length of time after taking up the active state.

* * * * *